United States Patent [19]

Fantoni et al.

[11] Patent Number: 4,964,338

[45] Date of Patent: Oct. 23, 1990

[54] METHOD OF MECHANICALLY JOINING THE MARGINAL PORTIONS OF A BLANK OF A PRINTING PLATE FOR ROTARY PRINTING, AND PRINTING PLATE THUS PRODUCED

[75] Inventors: Giuseppe Fantoni, Ozzano M.to; Daniele Temporin, Casale M.to, both of Italy

[73] Assignee: Officine Meccaniche G. Cerutti S.p.A., Casale Monferrato, Italy

[21] Appl. No.: 301,654

[22] Filed: Jan. 25, 1989

[51] Int. Cl.[5] ..... B41F 27/06; B41C 3/00

[52] U.S. Cl. ..... 101/378; 101/415.1; 101/456; 101/463.1; 29/521

[58] Field of Search ..... 101/415.1, 460, 461, 101/462, 473, 378, 401.1, 456, 463.1; 29/460, 521; 413/4, 7, 8

[56] References Cited

U.S. PATENT DOCUMENTS

| | | | |
|---|---|---|---|
| 2,322,845 | 6/1943 | Goldsworthy | 413/7 |
| 3,125,056 | 3/1964 | Kaiser | 413/7 |
| 4,332,197 | 6/1982 | Dulin | 101/415.1 |
| 4,515,375 | 5/1985 | Bleckmann et al. | 101/415.1 |
| 4,727,806 | 3/1988 | Green, Sr. | 101/415.1 |

FOREIGN PATENT DOCUMENTS

| | | | |
|---|---|---|---|
| 306986 | 3/1989 | European Pat. Off. | 101/415.1 |
| 8036830 | 10/1978 | Japan | 29/521 |
| 367436 | 2/1932 | United Kingdom | 101/415.1 |

*Primary Examiner*—Edgar S. Burr
*Assistant Examiner*—Ren Yan
*Attorney, Agent, or Firm*—Peter K. Kontler

[57] ABSTRACT

The marginal portions of a printing plate for rotary printing are joined together to form a cylindrical printing plate, which can be mounted on a printing roller, for example, on a printing roller of extensible diameter. The joint is made by stripping the photosensitive coating of the printing plate at the two marginal portions forming a pocket in one marginal portion and inserting the other marginal portion, bent by about 90°, into the pocket. The joint can be made along a circumferential line of the cylinder or along a line which is inclined relative to the circumferential lines of the cylinder.

The plate can be mounted with the bent-off and radially inwards-projecting marginal portions, or these marginal portions can be arranged at an inclination to the cylinder radius. The inlet between the two adjacent panels of the pocket is filled with a hardenable material. Thus, a joint is created which forms a continuous, smooth surface for the printing plate in the circumferential direction. The filling material can be removed after the printing plate has been used, so that storage of the printing plate as a flat plate becomes possible. Alternatively, the joint between the plate ends can also be made durable by introducing an adhesive between the marginal portions, in other thus to form a durable joint also in the axial direction.

12 Claims, 2 Drawing Sheets

METHOD OF MECHANICALLY JOINING THE MARGINAL PORTIONS OF A BLANK OF A PRINTING PLATE FOR ROTARY PRINTING, AND PRINTING PLATE THUS PRODUCED

BACKGROUND OF THE INVENTION

The invention relates to a method of joining together the marcinal portions of a printing plate for a rotary press. The invention also relates to the printing plate produced in accordance with the method. In order to increase the output of rotary presses, it has already been proposed to replace the copper coating on the printing roller by a matrix which forms the printing plate and the outer coating of which consists of a photosensitive material.

Since such matrices are usually produced as flat blanks it is necessary to join the two marginal portions of the blank together and mount this printing plate accurately and in a fixed position on the printing roller. It has already been proposed to connect the two ends of the printing plate by step punching step, in order thus to establish a positive mutual joint of the plate ends. These punchings which provide connection between the marginal portions of a positive of the plate prevent a separation of the marginal portions in the tangential direction of the cylinder. In the known design, an adhesive or a hardenable material is provided on the plate surface in order to prevent separation of the marginal portions of the plate which have been joined together. This filling material is also provided in order to ensure the continuity and smoothness, required for printing plates, of the surface at the butt joint. Such a printing plate is used in a cylinder which is extensible in the radial direction and has magnetic holding devices which fix the ends of the printing plate on the periphery of the printing roller.

This known type of plate joining has various disadvantages. On the one hand, a special and, above all, highly accurate working of the two marginal portions is necessary (punching step) in order to allow positive joining of the marginal portions. Furthermore, the punchings for positive joining necessarily have considerable dimensions, which substantially restrict the useful area for applying the print image to the plate. Moreover, the printing plate described can be used only together with a cylinder of particular design. The known plates are not interchangeable and, in most cases, the positive joint must be made directly on the printing roller on which the printing plate is used.

OBJECT OF THE INVENTION

It is an object of the invention to avoid the disadvantages of the state of the art and to propose a novel method for joining the marginal portions of printing plates of the said type, and a printing plate, produced in this way, for rotary presses.

SUMMARY OF THE INVENTION

This object is achieved by the method according to the invention for joining the marginal portions of a blank of a printing plate for rotary printing, consisting of a metallic support or sheet and a photosensitive coating, by the following procedural steps:

(a) stripping the photosensitive coating at two marginal portions of the blank (b) forming pocket or double bend in one marginal portion end and angling off the other marginal portion, and introducing the angling into the pocket previously made, and (c) applying a hardening material along the inlet of the pocket in order to produce a continuous surface of the printing plate along the butt joint.

According to a further advantageous embodiment, the butt joint between the marginal portions can be arranged to be inclined at a certain angle to the radius of the cylinder or completely bent over.

Futhermore, the butt joint can be made as a durable joint by filling in an adhesive between the marginal portions. The printing plate can also be produced to be releasable, so that it can again assume its original, flat form after the printing step.

The invention also relates to a printing plate, the marginal portions of which are fitted together in accordance with the method demonstrated.

The invention can be seen from the description, which now follows, of certain illustrative examples which are represented in the attached drawings.

DESCRIPTION OF PREFERRED EMBODIMENTS

Figure 1:
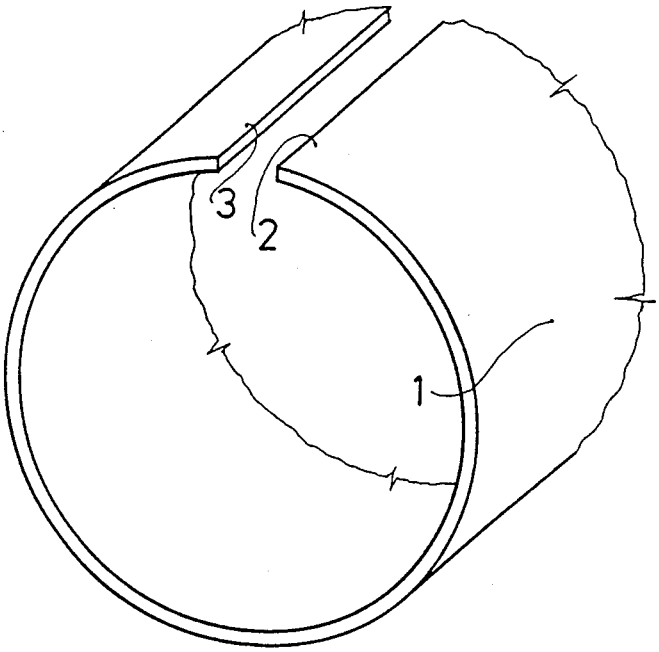
FIG. 1 shows a perspective view of a portion of the printing plate before fitting together.

In FIG. 1, an elongated tubular printing plate 1 of known construction for the use in a rotary press is shown. Only a part of the printing plate 1 is shown, and it has axially parallel 2 and 3. The plate 1 is obtained from a blank which has already been deformed in such a way that an elastic body of cylindrical shape is formed. In FIG. 1, the marginal portions 2 and 3 have not yet been joined to one another.

According to the invention, the length or developed view of the plate 1 is greater than the circumference of the printing cylinder used, since the two marginal portions 2 and 3 must be available for making the plate butt joint.

Figure 2:
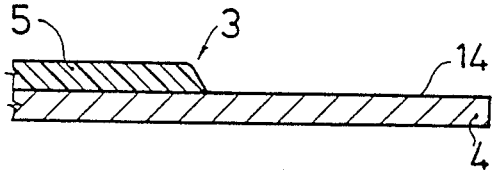
FIGS. 2 and 3 show two embodiments of the printing plate in section.

FIG. 2 shows a partial section of the marginal portion 3, which indicates the structure of the printing plate. The plate consists of a metallic support layer of foundation sheet 4, for example of steel sheet, to which a photosensitive coating or layer 5 of polymer material has been applied. This coating is then photochemically processed in a known manner, in order to produce the printing image on the printing plate.

FIG. 2 shows the right-hand end of the plate, from which the photosensitive coating has already been removed along the part 14. The part 14 of the marginal portion 3 is later used for making the butt joint between the two marginal portion. Stripping of the photosensitive layer 5 can be carried out by photochemical means or mechanically by machining, as shown in FIG. 2.

Figure 3:
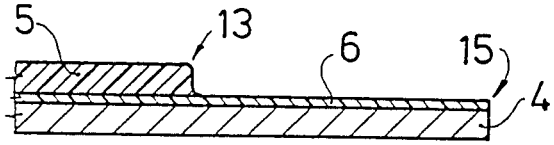

FIG. 3 shows a further illustrative embodiment of a blank of a printing, plate in section. The blank consists of a metallic support sheet 4, a photosensitive layer 5 and a thin intermediate layer 6 which has been the object of ensuring improved anchorage of the photosensitive layer on the support sheet 4.

As shown in FIG. 3, a part 15 of the marginal portion was freed of the photosensitive coating. This can, for example, also be effected by photochemical means, the intermediate layer 6 being left in place. However, the part 15 can also be prepared by mechanical removal of material. In this case, the layer 6 would also be stripped of in an advantageous manner.

Figure 4:
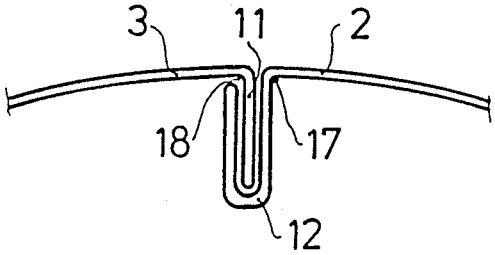
FIGS. 4–6 show three embodiments of the plate butt joint.

Referring to FIG. 4, the end marginal portion 2 is provided with a double bend 12 for making a pocket, which is done by bending off the marginal portion 2 by about 90° and by carrying out two further, immediately successive bends (U-shaped). The angled part 11, part of the marginal portion 3 which was likewise bent off by 90° at 18 of marginal portion 3 3, is introduced into this pocket by way of a longitudinally extending inlet at the external surface of the printing plate 1, i.e., at that side of the sheet 4 which carries the layer 5.

In FIG. 4, neither an adhesive nor another hardening filler is provided. Provision of an adhesive or filler will be described later by reference to FIGS. 7 and 8.

The butt joint, which is diagrammatically shown in FIG. 4, extends in the radial direction of the printing plate and represents a butt joint with a large space requirement in the interior of the printing plate. A corresponding groove of suitable depth must therefore be provided in the printing roller. If the depth of this groove is to be reduced, it is advantageous to use the embodiment according to FIG. 5, for the description of which the same reference symbols were used.

Corresponding to this further embodiment, the bending angle of the pocket 12 is less than 90° (relative to the plane starting surface). The bending angle of the part 11 of the marginal portions 3 is also less than 90° and is substantially equal to the angle of the pocket 12. In this way, the joint is inclined with reference to a plane including the axis of the printing roller and inlet of the pocket 12 so that the (radial) depth of the corresponding groove for introducing the junction is of smaller dimensions.

Figure 6:
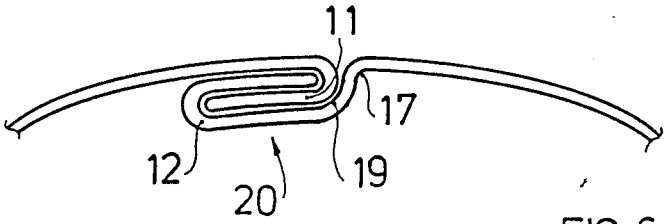

Finally, FIG. 6 shows a further embodiment in which the pocket is folded over completely towards the internal surface of the printing plate. In other words, the deflection 17 of the angle is about 90°. A futher folding 19 by 90° is provided, and the folding 18 is made over an angle of 180°. As a result, the butt joint 20 is of flat shape and only requires little space on the inside of the printing plate.

Figure 5:
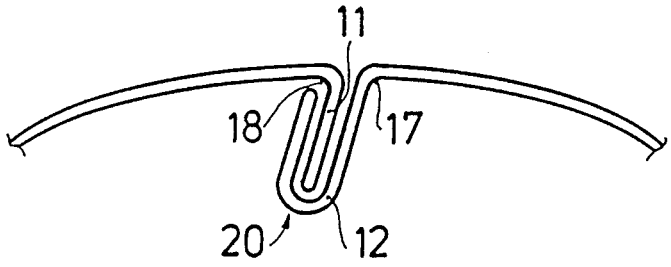

The butt joints, which are shown diagrammatically in FIGS. 4–6, are sealed by at least one or body of hardenable filler material or adhesive along the inlet of the pocket between two adjacent foldings 17, 18 of the marginal portions 2, 3. A butt joint for the printing plate is thus formed, which ensures continuity on the external surface of the printing plate between those portions of the outer side of the deformed sheet 4 which flank the inlet. In this way, irregularities in the use of the printing plate, undesired wear of the printing plate and other interfering secondary phenomena are avoided.

Figure 7:
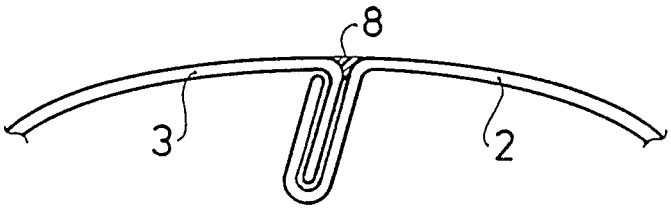
FIGS. 7 and 8 show further embodiments of the butt joint corresponding to FIG. 5

Even though only the provision of one filling or body for one butt joint according to FIG. 5 is shown in FIG. 7, it is obvious that a filler seam 8, that is to say a joint in the peripheral direction by means of a self-hardening material or by means of an adhesive to produce a smooth and continuous or external surface of the plate, can be used, for all the points described.

Using these embodiments, which represent a butt joint in the axial direction and exclusively show a mechanical joint, and as a result of the use of a filler or adhesive, the printing plate is not permanently deformed as a cylinder. In fact, the joint seam of adhesive or filler 8 can be destroyed or generally removed at the end of the printing process. By means of deforming the marginal portions 2 and 3, it is possible to undo that butt joint and hence to convert the matrix again into its original form of a flat plate, which substantially simplifies storage of the printing plate.

Figure 8:
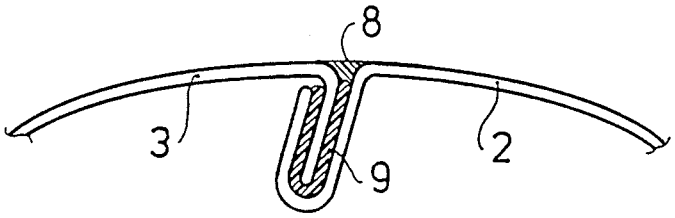

As an alternative proposal, as shown in FIG. 8. always with reference to the diagrammatically shown variant in FIG. 5, an adhesive or a hardening filler material 9 can also be provided in the interior of the double bend to bond the bent part 11 of the marginal portion 3 to the pocket 12 of the marginal portion 2. This gives a joint in the axial direction which does not represent a releasable mechanical connection but leads to the making of the permanent connection between the double-bent plate ends. This type of joint which can also be used in other embodiments leads to the formation of a permanently cylindrical printing plate.

The invention achieves the proposed objects. The butt joint allows the total useful area of the printing roller to be utilized in practice for taking the printing image. The plate and the associated butt joint are simple and inexpensive and, for the plate to assume again the form of a flat plate, the joint can be undone as desired. Finally, a limited space requirement for the butt joint in the interior of the plate can be obtained, and this space can be created in a simple manner via the provision of a groove or recess in the surface of the printing roller.

Since the butt joint of the marginal portions can already be prepared on another auxiliary cylinder and can subsequently be mounted rapidly on the actual printing roller, a substantial time-saving for the change of printing plates is achieved, and this considerably increases the performance capacity of the press.

In the drawings, the joint location is shown along a circumferential line of the cylinder, but the joint can also be made at an inclination to the circumferential line of the cylinder, which has advantages and leads only to a modest restriction of the useful area on the cylinder.

We claim:

1. A method of making a printing plate for application to the peripheral surface of printing roller, comprising the steps of forming a blank having a flexible foundation sheet with two substantially parallel marginal portions and a photosensitive layer at one side of the foundation sheet; providing one of the marginal portions with a longitudinally extending pocket having a narrow inlet at the one side of the sheet; introducing the other marginal portion of the sheet into the pocket by way of the inlet to establish a mechanical connection between the marginal portions and converting the blank into a tube with the pocket located within and the photosensitive material located at the exterior of the tube; and filling the inlet of the pocket with a hardenable filler material to establish a smooth transition between those portions of the one side which flank the inlet.

2. The method of claim 1, further comprising the step of removing the photosensitive layer from at least one of the marginal portions prior to said converting step.

3. The method of claim 1, wherein the pocket is at least substantially flat and extends substantially radially of the tube.

4. The method of claim 1, wherein the pocket is inclined with reference to a plane including the inlet and the axis of the tube.

5. The method of claim 1, wherein the pocket is closely adjacent the internal surface of the tube.

6. The method of claim 1, further comprising the step of introducing hardenable bonding material into the pocket to bond the marginal portions to each other.

7. The method of claim 1, further comprising the step of photochemically removing the photosensitive layer from at least one of the marginal portions prior to said converting step.

8. The method of claim 1, further comprising the step of mechanically removing the photosensitive layer from at least one of the marginal portions prior to said converting step.

9. An elongated tubular printing plate having an internal surface and an external surface and including a flexible foundation sheet at said internal surface and a photosnsitive layer at said external surface, said sheet having two marginal portions extending substantially longitudinally of and disposed within the tubular plate, one of said marginal portions having an elongated pocket with an inlet at said external surface and the other of said marginal portions extending into said pocket so that said marginal portions are mechanically connected to each other; and a body of hardened filler material disposed in said inlet and providing a smooth transition between those portions of said external surface which are adjacent said inlet.

10. The printing plate of claim 9, wherein said body of filler material is removable to permit extraction of said other marginal portion from said pocket by way of said inlet.

11. The printing plate according to claim 9, wherein said pocket is at least substantially flat and extends substantially radially of the printing plate.

12. The printing plate of claim 9, wherein said pocket is inclined with reference to a plane including said inlet and the axis of the printing plate.

* * * * *